US009469108B2

(12) United States Patent
Nakao et al.

(10) Patent No.: US 9,469,108 B2
(45) Date of Patent: Oct. 18, 2016

(54) LIQUID EJECTING HEAD AND LIQUID EJECTING APPARATUS

(71) Applicant: SEIKO EPSON CORPORATION, Tokyo (JP)

(72) Inventors: Hajime Nakao, Azumino (JP); Shunsuke Watanabe, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 2 days.

(21) Appl. No.: 14/226,943

(22) Filed: Mar. 27, 2014

(65) Prior Publication Data

US 2014/0292950 A1 Oct. 2, 2014

(30) Foreign Application Priority Data

Mar. 28, 2013 (JP) ..... 2013-070583

(51) Int. Cl.
*B41J 2/14* (2006.01)
*B41J 2/055* (2006.01)

(52) U.S. Cl.
CPC ..... *B41J 2/14233* (2013.01); *B41J 2/055* (2013.01); *B41J 2002/14258* (2013.01); *B41J 2002/14266* (2013.01); *B41J 2002/14306* (2013.01)

(58) Field of Classification Search
CPC ..... B41J 2/14233; B41J 2/14266; B41J 2002/14241; B41J 2002/1425; B41J 2002/14258; B41J 2002/14266
USPC ..... 347/71, 68, 72
See application file for complete search history.

(56) References Cited

U.S. PATENT DOCUMENTS

| | | | | |
|---|---|---|---|---|
| 5,438,739 | A * | 8/1995 | Granzow | 29/25.35 |
| 5,933,170 | A * | 8/1999 | Takeuchi et al. | 347/71 |
| 6,435,653 | B1 * | 8/2002 | Boyd et al. | 347/42 |
| 7,048,362 | B2 * | 5/2006 | Takahashi | 347/72 |
| 2002/0196315 | A1 * | 12/2002 | Isono et al. | 347/71 |
| 2006/0066685 | A1 * | 3/2006 | Sugahara | 347/68 |
| 2006/0197808 | A1 * | 9/2006 | Tsukamoto | 347/68 |
| 2006/0284939 | A1 * | 12/2006 | Katayama | 347/72 |
| 2010/0165057 | A1 * | 7/2010 | Morita | 347/68 |
| 2011/0175971 | A1 * | 7/2011 | Newton | B41J 2/14233 347/71 |
| 2012/0056947 | A1 * | 3/2012 | Tanuma | B41J 2/14233 347/71 |

FOREIGN PATENT DOCUMENTS

| | | | |
|---|---|---|---|
| JP | 3144948 | B2 | 1/2001 |
| JP | 2012-069622 | A | 4/2012 |
| JP | 2012-106513 | A | 6/2012 |

* cited by examiner

*Primary Examiner* — Matthew Luu
*Assistant Examiner* — Patrick King
(74) *Attorney, Agent, or Firm* — Maschoff Brennan

(57) ABSTRACT

A liquid ejecting head which ejects a liquid from a nozzle of a nozzle plate by means of pressure change in a pressure chamber includes a first member made of ceramics and including the pressure chamber, a second member located between the first member and the nozzle plate, the second member being made of a metal and including a first flow path at a position upstream to the pressure chamber so as to regulate the amount of liquid which flows into the pressure chamber, and a ground wire that grounds the second member.

8 Claims, 5 Drawing Sheets

LIQUID EJECTING HEAD AND LIQUID EJECTING APPARATUS

BACKGROUND

1. Technical Field

The present invention relates to a liquid ejecting head and a liquid ejecting apparatus.

2. Related Art

JP-A-2012-106513 discloses an ink jet head which includes a flow path unit that is formed by a stack of a nozzle plate which is made of a sheet of resin such as polyimide and a plurality of metal plates, and a piezoelectric actuator that is made of a ceramic material such as lead zirconate titanate (PZT) and is bonded to the flow path unit.

In the above ink jet head, a substantial portion of the flow path unit except for the nozzle plate is formed by a plurality of staked metal plates. In this configuration, it may be difficult to perform a fine and precise processing with sufficient accuracy on the flow path unit. Further, a liquid in the flow path in the ink jet head may be electrically charged. This causes the ejecting direction of the liquid to be varied, for example, depending on the electrically (electrostatically) charged state of a printing medium and may affect the quality of recording. Accordingly, the liquid in the flow path needs to be appropriately grounded.

SUMMARY

An advantage of some aspects of the invention is that a liquid ejecting head on which a fine processing can be performed at least at a predetermined area and which is suitable for grounding the liquid in the flow path, and a liquid ejecting apparatus having the same is provided.

According to an aspect of the invention, a liquid ejecting head which ejects a liquid from a nozzle of a nozzle plate by means of pressure change in a pressure chamber includes a first member made of ceramics and including the pressure chamber, a second member located between the first member and the nozzle plate, the second member being made of a metal and including a first flow path at a position upstream to the pressure chamber so as to regulate the amount of liquid which flows into the pressure chamber, and a ground wire that grounds the second member.

With this configuration, it is possible to provide a sufficient accuracy in forming the pressure chamber which requires a fine and precise processing since the first member which includes the pressure chamber is made of ceramics. Further, as the density of the nozzles is increased for achieving printing with high definition, the pressure chambers also need to be arranged with high density. Using ceramics for the first member allows the density of the pressure chambers to be increased (more pressure chambers can be formed in a smaller area). Further, in addition to ensuring a processing accuracy in forming the pressure, it is also possible to achieve an increased strength of the first flow path, reduced manufacturing cost, and an appropriate ground of the liquid in the flow path by using a metal for forming the second member which includes a first flow path that regulates the amount of liquid which flows into the pressure chamber and providing a ground wire for the second member. The term "ground" as used herein is used in a broad meaning, and is not limited to a connection to the ground surface, but also includes a connection to a certain potential other than zero volt (for example, a reference potential). Further, using ceramics for forming the first member which includes the pressure chamber allows the piezoelectric elements to be formed easily and accurately at positions which correspond to the pressure chambers by self-alignment which uses the pressure chambers as a mask.

According to the above aspect of the invention, the first flow path may be at least part of a flow path which extends between a common liquid chamber from which the liquid is supplied to at least one pressure chamber and the pressure chamber. With this configuration, it is possible to ensure a sufficient strength of the first flow path which accurately regulates the amount of the liquid supplied from the common liquid chamber to the pressure chamber.

According to the above aspect of the invention, the first flow path may be a portion having the smallest cross sectional area of the flow path which extends between the common liquid chamber and the pressure chamber. With this configuration, it is possible to ensure a sufficient strength of a portion (the first flow path) having the smallest cross sectional area of the flow path which extends between the common liquid chamber and the pressure chamber so as to regulate the amount of the liquid supplied from the common liquid chamber to the pressure chamber.

According to the above aspect of the invention, the second member may have the same configuration as that of the common liquid chamber. With this configuration, it is possible to provide a sufficient strength of the first flow path and the common liquid chamber and reduce the manufacturing cost since the first flow path and the common liquid chamber are made of a metal.

According to the above aspect of the invention, the liquid ejecting head may further include a third member made of ceramics and includes the common liquid chamber. With this configuration, it is possible to easily perform processing of the common liquid chamber and easily ensure a volume of the common liquid chamber without using a plurality of metal plates.

According to the above aspect of the invention, the first flow path may have a longitudinal axis which is parallel to a plane of the nozzle plate. With this configuration, routing of the first flow path is easy since the longitudinal axis of the first flow path is parallel to a plane of the nozzle plate, and a degree of freedom of design for positioning of the pressure chamber and the common liquid chamber which is connected to the pressure chamber via the first flow path. Further, the first flow path is formed as a long flow path in order to ensure the resistance to the liquid flow. As a result, a large contact area with liquid is provided. That is, the liquid is grounded with certainty since a contact area between the liquid and the metal (wall surface of the first flow path) is appropriately provided.

According to another aspect of the invention, a liquid ejecting head which ejects a liquid from a nozzle of a nozzle plate by means of pressure change in a pressure chamber includes a first member made of ceramics and including the pressure chamber, a second member having a first flow path which is a portion having the smallest cross sectional area of the flow path which extends between the common liquid chamber from which the liquid is supplied to at least one pressure chamber and the pressure chamber, and a ground wire that grounds the second member. The technical idea according to the invention is implemented not only in the form of liquid ejecting head, and may be implemented in other forms. For example, an apparatus (liquid ejecting apparatus) on which the foregoing liquid ejecting head is mounted can be regarded as being included in the invention. Further, a method of manufacturing the foregoing liquid ejecting head and the foregoing liquid ejecting apparatus can be also regarded as being included in the invention.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
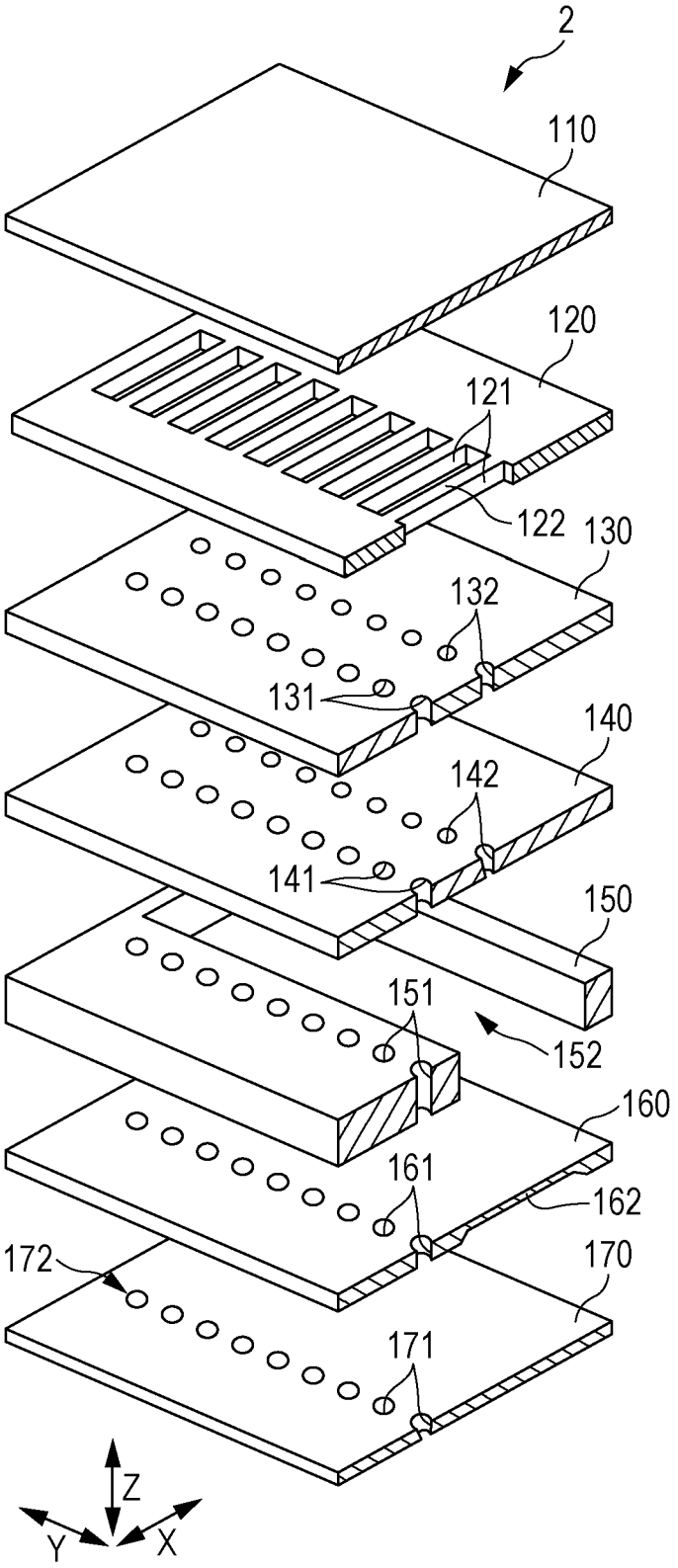
FIG. 1 is an exploded perspective view of part of a main component of a liquid ejecting head.

Embodiments of the invention will be described below with reference to the drawings. FIG. 1 is an exploded perspective view of part of a flow path unit 2 which is one of the main components of a liquid ejecting head 1 (see FIG. 2) according to this embodiment. The liquid ejecting head 1 herein will be described as an ink jet recording head that ejects ink. The flow path unit 2 is formed by a plurality of plate members which are stacked in a certain stacking direction. The flow path unit 2 includes a vibration plate 110, a pressure chamber plate 120, a first connection plate 130, a second connection plate 140, a reservoir plate 150, a compliance plate 160, and a nozzle plate 170, in sequence from one end to the other end of the stacking direction.

Although the plates 110, 120, 130, 140, 150, 160, 170 shown in FIG. 1 (and FIG. 2) are individually designated for convenience, the plates 110, 120, 130, 140, 150, 160, 170 may not be necessarily provided as separate members and some of those plates may be integrally formed. Further, the flow path unit 2 may not include some of the plates 110, 120, 130, 140, 150, 160, 170, or alternatively, may include additional member (plate) which is not shown in the figure. In the following description, the stacking direction is also referred to as Z direction. In the Z direction, a side on which the vibration plate 110 is located is referred to as an "upper side", while a side on which the nozzle plate 170 is located is referred to as a "lower side".

The pressure chamber plate 120 includes a plurality of pressure chambers 121 which serve as part of a liquid flow path. Each pressure chamber 121 penetrates the pressure chamber plate 120 and has an elongated shape which extends in the X direction. The pressure chambers 121 are arranged in the Y direction which is perpendicular to the X direction. Both the X and Y directions are perpendicular to the Z direction. The pressure chambers 121 are separated by partition walls 122. The terms "parallel", "perpendicular", "vertical" and "identical" as used herein for the direction, position, shape, etc. of the configuration of the liquid ejecting head 1 do not necessarily have a meaning of strictly parallel, perpendicular, vertical and identical, but may also include a tolerance which is acceptable in terms of product performance, a manufacture tolerance and the like. Further, the term "contact" between elements as used herein refers to a state in which the elements are in contact with each other with or without an additive or the like.

The upper surface of the pressure chamber plate 120 is sealed by the vibration plate 110. The lower surface of the pressure chamber plate 120 is in contact with the first connection plate 130. The first connection plate 130 includes a plurality of first communication holes 131 and a plurality of second supply holes 132. Each of the first communication holes 131 communicate with each of the pressure chambers 121 at one end of the longitudinal axis of the pressure chambers 121, while each of the second supply holes 132 communicate with each of the pressure chambers 121 at the other end of the longitudinal axis of the pressure chambers 121. Both the first communication holes 131 and the second supply holes 132 penetrate the first connection plate 130.

The lower surface of the first connection plate 130 is in contact with the second connection plate 140. The second connection plate 140 includes a plurality of second communication holes 141 and a plurality of first supply holes 142. Each of the second communication holes 141 communicate with each of the first communication holes 131 at one end of the longitudinal axis of the pressure chambers 121, while each of the first supply holes 142 communicate with each of the second supply holes 132 at the other end of the longitudinal axis of the pressure chambers 121. Both the second communication holes 141 and the first supply holes 142 penetrate the second connection plate 140.

The lower surface of the second connection plate 140 is in contact with the reservoir plate 150. The reservoir plate 150 includes a plurality of third communication holes 151 and a reservoir 152. Each of the third communication holes 151 communicate with each of the second communication holes 141. Both the third communication holes 151 and the reservoir 152 penetrate the reservoir plate 150. The reservoir 152 has a length in the Y direction which extends to the same extent as the length of a nozzle row 172 in the Y direction, which will be described later. Further, the upper side of the reservoir 152 communicates with the respective first supply holes 142. In other words, a portion of the reservoir 152 except for the area which corresponds to the first supply holes 142 on the upper side is sealed by the second connection plate 140. The reservoir 152 is also referred to as a common liquid chamber or a common ink chamber. The second connection plate 140 is also referred to as a seal plate.

The lower surface of the reservoir plate 150 is in contact with the compliance plate 160. The lower surface of the compliance plate 160 is in contact with the nozzle plate 170. The compliance plate 160 has a plurality of fourth communication holes 161, each of which communicate with each of the third communication holes 151. The fourth communication holes 161 penetrates the compliance plate 160. The upper surface of the compliance plate 160 seals the lower side of the reservoir 152. A portion of the compliance plate 160 which seals the reservoir 152 has a thickness smaller than the remaining area, which is referred to as a thin film section 162. The thin film section 162 has an elastic property. A space is formed between the lower surface of the thin film section 162 and the nozzle plate 170. The thin film section 162 deforms toward the nozzle plate 170 in response to a pressure change in the reservoir 152, thereby reducing the pressure change in the reservoir 152.

The nozzle plate 170 has a plurality of nozzles 171 which serve as through holes through which ink is ejected. Each of the nozzles 171 communicate with each of the pressure chambers 121 via flow paths formed by the communication holes 131, 141, 151, 161. Accordingly, in the example shown in FIG. 1 (and FIG. 2), each of the nozzles 171 communicate with each of the fourth communication holes 161. As shown in FIG. 1, the nozzle plate 170 includes the nozzle row 172 in which the nozzles 171 are arranged in the Y direction at a predetermined interval. The nozzle plate 170 may be also configured to include a plurality of nozzle rows, each of which includes a plurality of nozzles 171 arranged in the Y direction. The nozzle rows are arranged side by side in the X direction with the nozzles in one nozzle row being offset in the Y direction from the nozzles in another nozzle row (so-called houndstooth pattern).

Figure 2:
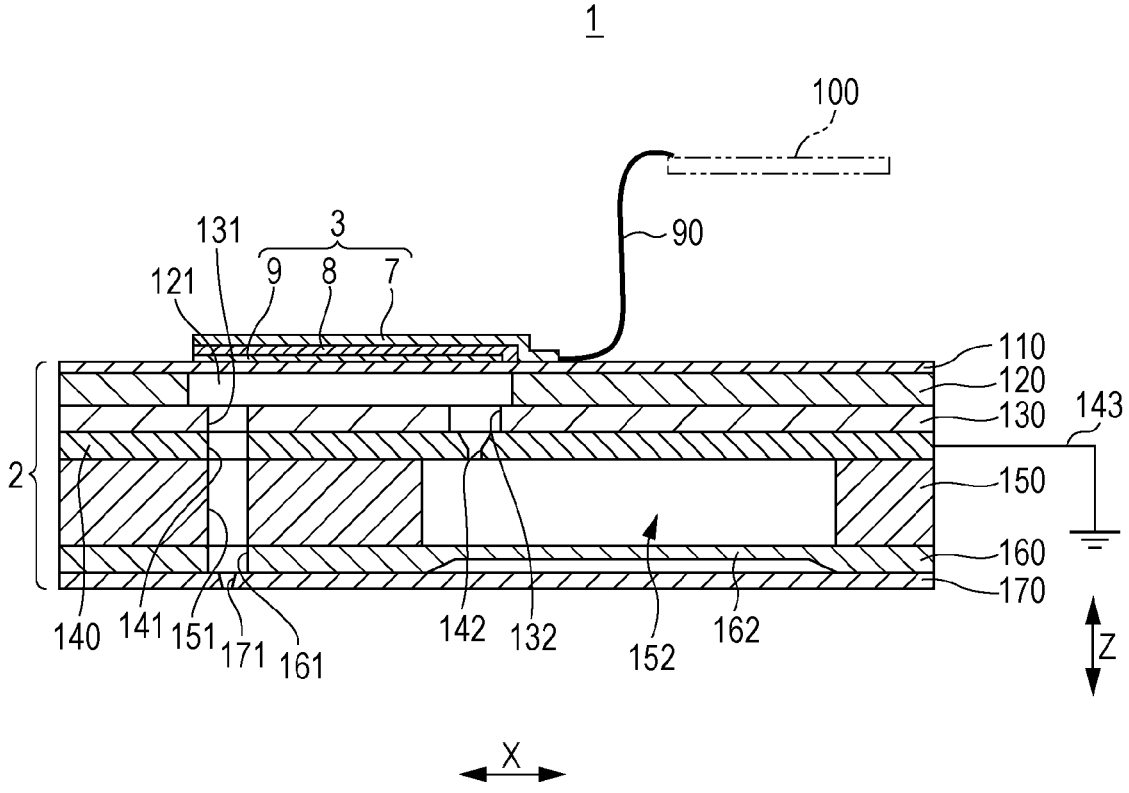
FIG. 2 is a sectional view of a cross section of the liquid ejecting head.

FIG. 2 is a sectional view of the liquid ejecting head 1 and includes a cross section of the flow path unit 2 shown in FIG. 1. The cross section is perpendicular to the Y direction. As shown in FIG. 2, one pressure chamber 121 communicates with one nozzle 171 via the communication holes 131, 141, 151, 161. Further, actuators (piezoelectric elements) 3 are disposed on a side of the vibration plate 10 which is opposite of the pressure chambers 121 at positions which substantially correspond to the pressure chambers 121. Each piezoelectric element 3 includes a lower electrode 9, a piezoelectric layer 8 made of a ceramic material such as PZT, and an upper electrode 7, which are stacked in sequence from the side of the vibration plate 110. For example, the upper electrode 7 is an individual electrode which is provided for each piezoelectric element 3 that corresponds to each pressure chamber 121, while the lower electrode 9 is a common electrode which is shared by a plurality of piezoelectric elements 3. The common electrode and the individual electrode are connected to a control circuit substrate 100 via a cable (such as a flexible substrate) 90 or the like.

When a voltage is selectively applied to the individual electrodes (upper electrode 7) by the control circuit substrate 100, a potential difference between the individual electrode (upper electrode 7) and the common electrode (lower electrode 9) is generated. In response to the potential difference, the piezoelectric element 3 deforms, which causes the vibration plate 110 to deform toward the pressure chamber 121. Ink is supplied from the exterior to the reservoir 152 via an ink supply path which is not shown in the figure. After the ink is supplied to the reservoir 152, the ink is supplied to the pressure chambers 121 via the first supply holes 142 and the second supply holes 132. As the vibration plate 110 deforms, a pressure change is generated in the pressure chambers 121. In response to the pressure change, the ink in the pressure chambers 121 is ejected from the nozzles 171 via the communication holes 131, 141, 151, 161. Accordingly, the flow path extends from the upstream side in which the reservoir 152 is located to the downstream side in which the nozzles 171 are located.

In such a configuration, at least the pressure chamber plate 120 corresponds to an example of a first member which has the pressure chambers. Further, the first supply holes 142, which form at least part of the flow path which extends between the reservoir 152 and the pressure chambers 121, correspond to an example of a first flow path that is located upstream with respect to the pressure chambers 121 and controls the amount of a liquid which flows into the pressure chambers 121. The first supply hole 142 is formed in a tapered through hole having a cross sectional area of the flow path (a cross sectional area which is perpendicular to the Z direction) which decreases from the upper end to the lower end. The lower end of the first supply hole 142 communicates with the reservoir 152. The first supply holes 142 are a portion having the smallest cross sectional area of the flow path between the reservoir 152 and the pressure chambers 121. That is, the first supply holes 142 increase a resistance to the ink flow, thereby adjusting the amount of ink which flows from the reservoir 152 into the pressure chambers 121 to be constant, and the amount of ink which flows back from the pressure chambers 121 to the reservoir 152 during deformation of the vibration plate 110 not to exceed a predetermined amount. The second connection plate 140 which includes the first supply holes 142 corresponds to at least an example of a second member which is located between the pressure chamber plate 120 and the nozzle plate 170. The term between the pressure chamber plate 120 and the nozzle plate 170 as described herein means between the pressure chamber plate 120 and the nozzle plate 170 in the Z direction.

In this embodiment, the pressure chamber plate 120 which corresponds to the first member is formed by calcining ceramics. The ceramics include, for example, zirconia. The second connection plate 140 which corresponds to the second member is formed by processing stainless steel or other metals. Using ceramics for the pressure chamber plate 120 allows a fine processing to be performed compared to a case with the pressure chamber plate 120 made of a metal. Accordingly, it is possible to provide a sufficient accuracy in forming the pressure chambers 121 which requires a fine and precise processing. Further, as the density of the nozzles 171 is increased for achieving printing with high definition, the pressure chambers 121 also need to be arranged with high density. In this embodiment, it is possible to further increase the density of the pressure chambers 121. The high density pressure chambers 121 allow the liquid ejecting head 1 to be reduced in size. Further, the second connection plate 140 which includes the first supply holes 142 requires a sufficient strength in order to ensure an adequate and accurate flow path resistance between the reservoir 152 and the pressure chambers 121. Since the second connection plate 140 is made of a metal, it is possible to provide a sufficient strength and reduce the manufacturing cost of the liquid ejecting head 1.

In this embodiment, as shown in FIG. 2, the second connection plate 140 is in contact with a ground wire 143 that grounds the second connection plate 140. Although FIG. 2 schematically shows the ground wire 143, the ground wire 143 may be grounded by any means. For example, the ground wire 143 may be connected to the control circuit substrate 100 via patterns, cables or the like and grounded to a specific ground point. Alternatively, grounding of the ground wire 143 may be achieved by connecting the ground wire 143 to a metal frame or the like of the liquid ejecting apparatus which includes the liquid ejecting head 1 via a metal housing or the like of the liquid ejecting head 1, which is not shown in the figure. The ground wire 143 connected to the second connection plate 140 which is made of a metal allows the ink which flows in the flow path of the flow path unit 2 to be grounded with certainty, thereby eliminating an adverse effect to the recording quality caused by electrically charged ink.

That is, according to this embodiment, it is possible to meet a various requirements such as an appropriate operation performed for a fine and precise processing, cost reduction, ensuring of strength, grounding of ink, etc. Further, the first connection plate 130 which includes the second supply holes 132 which form part of the flow path between the reservoir 152 and the pressure chambers 121 may be made of ceramics and integrally formed with the pressure chamber plate 120, or alternatively, may be made of a metal similarly to the second connection plate 140. Further, a component which corresponds to the second connection plate 140 may not be entirely made of a metal. Only a portion of the second connection plate 140 which includes at least an area which is connected to the ground wire 143 and an area which includes the first supply holes 142 may be continuously formed of a metal.

Moreover, the second member may be configured to have the reservoir 152. That is, a component which corresponds to the second connection plate 140 and the reservoir plate 150 may be formed by processing a stainless steel or any other metal. In such a configuration, it is possible to ensure a sufficient strength of the first flow path and the reservoir, and significantly reduce the manufacturing cost compared with the case using ceramics. Moreover, the vibration plate 110, the compliance plate 160, the nozzle plate 170 may be made of different materials such as metal, ceramics, resin, etc.

Further, using ceramics for the pressure chamber plate 120 is also advantageous in that the piezoelectric elements 3 can be formed easily and accurately at positions which correspond to the pressure chambers 121 by self-alignment using the pressure chambers as a mask. For example, a photoresist layer is formed on the vibration plate 110 and then a light is irradiated from a side of the pressure chambers 121 with a light shielding material being placed in the pressure chambers 121. Consequently, the photoresist layer is exposed except for the region masked by the light shielding material which is placed in the pressure chambers 121. When the unexposed photoresist layer is removed, a resist pattern is formed. The piezoelectric elements 3 can be formed on the vibration plate 110 so as to correspond to the positions of the pressure chambers 121 with accuracy by using the resist pattern.

The invention is not limited to the above embodiment, and without departing from the spirit of the invention, the invention can be implemented according to various embodiments including the following embodiments. The embodiments which is described above, and combinations with any of the following embodiments are also included in the scope of the invention.

Figure 3:
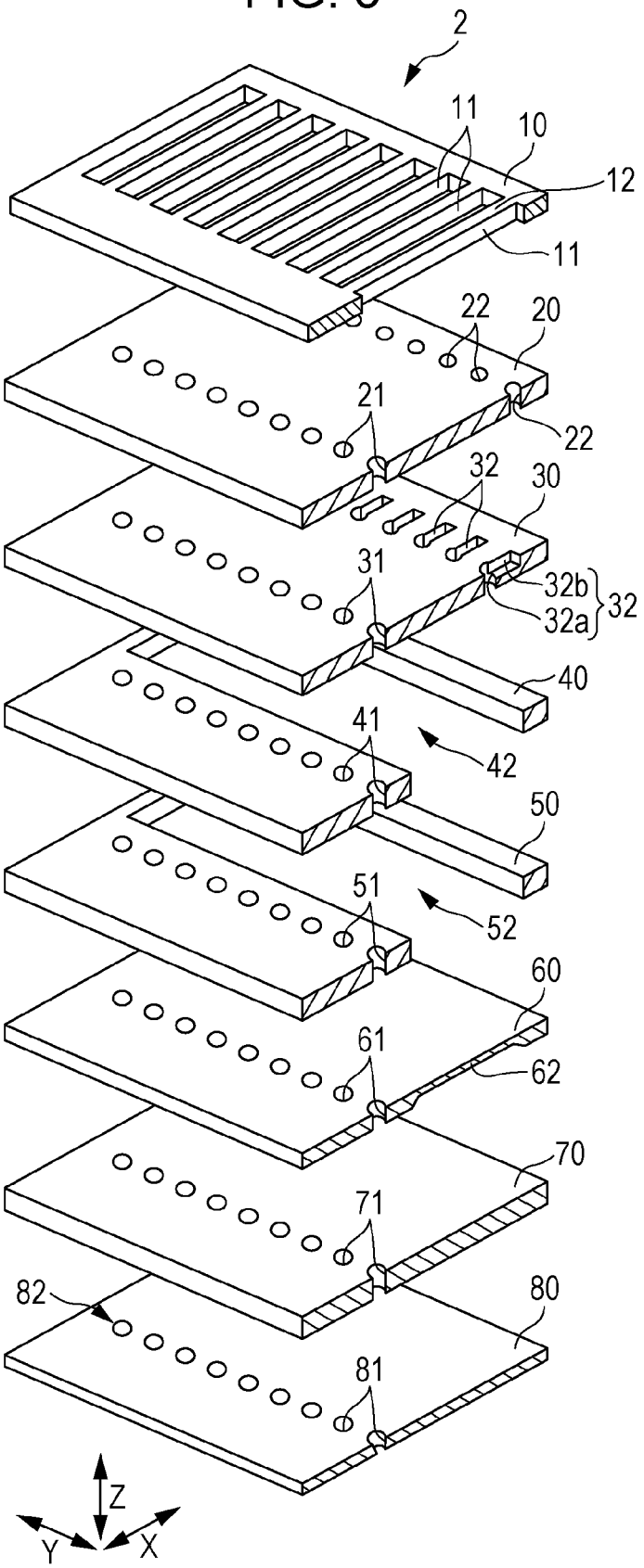
FIG. 3 is an exploded perspective view of another example of part of a main component of the liquid ejecting head.
Figure 4:
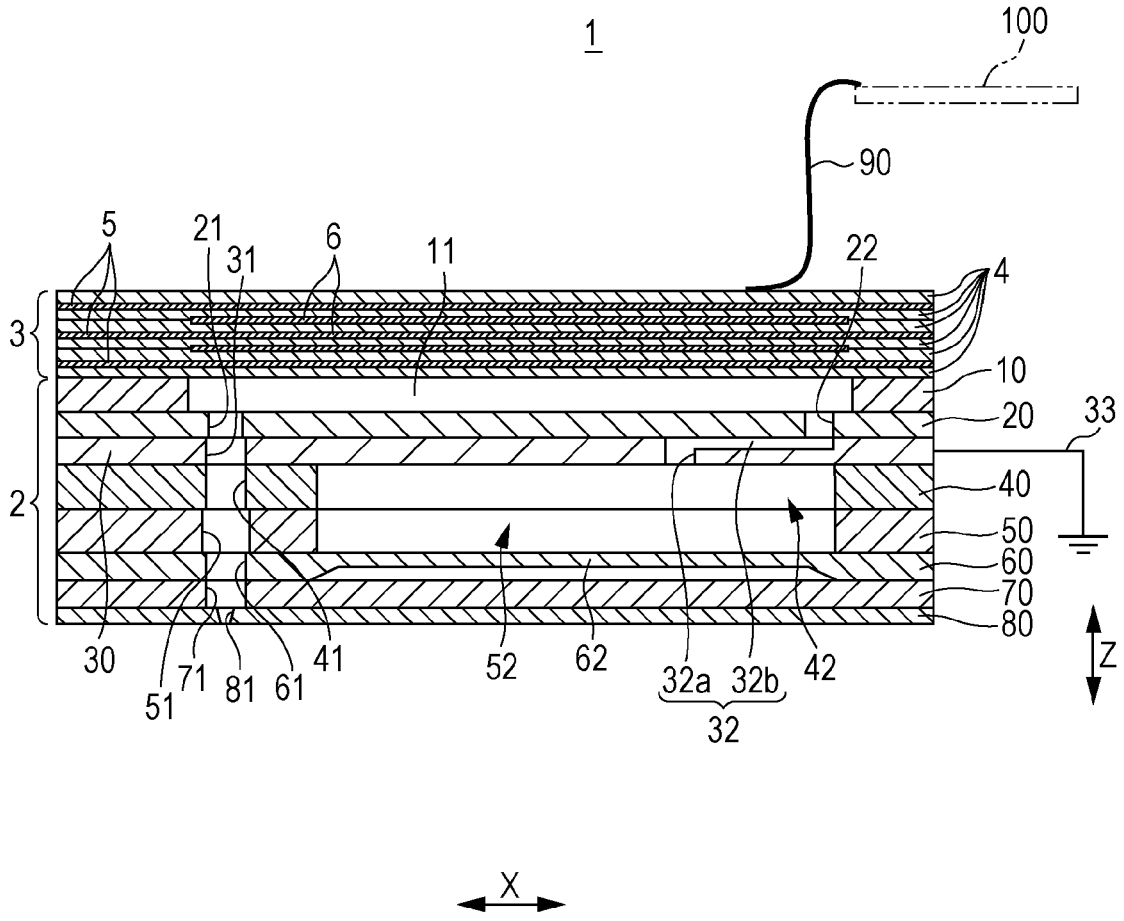
FIG. 4 is a sectional view of another example of a cross section of the liquid ejecting head.

FIG. 3 is an exploded perspective view of part of a flow path unit 2 which is one of the main components of the liquid ejecting head 1 (see FIG. 4) according to another embodiment. FIG. 4 is a sectional view of the liquid ejecting head 1 and includes a cross section of the flow path unit 2 shown in FIG. 3. The cross section is perpendicular to the Y direction. For convenience of explanation, the embodiment shown in FIGS. 1 and 2 is referred to as a first embodiment, and the embodiment shown in FIGS. 3 and 4 and described below is referred to as a second embodiment. The elements which are the same for both the first and the second embodiments will not be further described.

The flow path unit 2 according to the second embodiment includes a pressure chamber plate 10, a first connection plate 20, a second connection plate 30, a first reservoir plate 40, a second reservoir plate 50, a compliance plate 60, a cover plate 70, and a nozzle plate 80, in sequence from the upper end to the lower end of the Z direction.

Although the plates 10, 20, 30, 40, 50, 60, 70, 80 shown in FIGS. 3 and 4 are individually designated for convenience, the plates 10, 20, 30, 40, 50, 60, 70, 80 may not be necessarily provided as separate members and some of those plates may be integrally formed. Further, the flow path unit 2 may not include some of the plates 10, 20, 30, 40, 50, 60, 70, 80, or alternatively, may include additional member (plate) which is not shown in the figure.

The pressure chamber plate 10 includes a plurality of pressure chambers 11. Each pressure chamber 11 penetrates the pressure chamber plate 10 and has an elongated shape which extends in the X direction. The pressure chambers 11 are arranged in the Y direction which is perpendicular to the X direction. The pressure chambers 11 are separated by partition walls 12. The lower surface of the pressure chamber plate 10 is in contact with the first connection plate 20. The first connection plate 20 includes a plurality of first communication holes 21 and a plurality of second supply holes 22. Each of the first communication holes 21 communicate with each of the pressure chambers 11 at one end of the longitudinal axis of the pressure chambers 11, while each of the second supply holes 22 communicate with each of the pressure chambers 11 at the other end of the longitudinal axis of the pressure chambers 11. Both the first communication holes 21 and the second supply holes 22 penetrate the first connection plate 20.

The lower surface of the first connection plate 20 is in contact with the second connection plate 30. The second connection plate 30 includes a plurality of second communication holes 31 and a plurality of supply paths 32. Each of the second communication holes 31 communicate with each of the first communication holes 21 at one end of the longitudinal axis of the pressure chambers 11, while each of the supply paths 32 communicate with each of the second supply holes 22 at the other end of the longitudinal axis of the pressure chambers 11. The second communication holes 31 penetrates the second connection plate 30. Each supply path 32 includes a first supply hole 32*a* that penetrates the second connection plate 30 and an elongated connection flow path 32*b*. The connection flow path 32*b* is formed as a recess that opens to the upper surface of the second connection plate 30 and has an elongated shape which extends in the X direction. The connection flow paths 32*b* communicate with the first supply holes 32*a* at one end of the longitudinal axis of the connection flow paths 32*b*, and communicate with the second supply holes 22 at the other end of the longitudinal axis of the connection flow paths 32*b*.

The lower surface of the second connection plate 30 is in contact with the first reservoir plate 40, while the lower surface of the first reservoir plate 40 is in contact with the second reservoir plate 50. The first reservoir plate 40 includes a plurality of third communication holes 41 and a reservoir 42. Each of the third communication holes 41 communicate with each of the second communication holes 31. Both the third communication holes 41 and the reservoir 42 penetrate the first reservoir plate 40. Similarly, the second reservoir plate 50 includes a plurality of fourth communication holes 51 and a reservoir 52. Each of the fourth communication holes 51 communicate with each of the third communication holes 41. Both the fourth communication holes 51 and the reservoir 52 penetrate the second reservoir plate 50.

The reservoirs 42, 52 together form a single large cavity. In the second embodiment, the term "reservoir" alone refers to the cavity formed by the "reservoir 42" and the "reservoir 52". The reservoir has a length in the Y direction which extends to the same extent as the length of a nozzle row 82 in the Y direction. Further, the upper side of the reservoir communicates with the respective first supply holes 32*a*. In other words, a portion of the reservoir except for the area which corresponds to the first supply holes 32*a* on the upper side is sealed by the second connection plate 30.

The lower surface of the second reservoir plate 50 is in contact with the compliance plate 60, while the lower surface of the compliance plate 60 is in contact with the cover plate 70. The compliance plate 60 has a plurality of fifth communication holes 61, each of which communicate with each of the fourth communication holes 51. The fifth communication holes 61 penetrates the compliance plate 60. The upper surface of the compliance plate 60 seals the lower side of the reservoir. The cover plate 70 includes a plurality of sixth communication holes 71, each of which communicate with each of the fifth communication holes 61. The sixth communication holes 71 penetrates the cover plate 70. A portion of the compliance plate 60 which seals the reservoir is a thin film section 62. The thin film section 62 deforms toward the cover plate 70 in response to a pressure change in the reservoir, thereby reducing the pressure change in the reservoir.

The lower surface of the cover plate 70 is in contact with the nozzle plate 80. The nozzle plate 80 includes a plurality of nozzles 81. Each of the nozzles 81 communicate with each of the pressure chambers 11 via flow paths formed by the communication holes 21, 31, 41, 51, 61, 71. Accordingly, in the example shown in FIGS. 3 and 4, each of the nozzles 81 communicate with each of the sixth communication holes 71. In the flow path unit 2, the cover plate 70 may not be provided and the nozzle plate 80 may be in contact with the compliance plate 60. As shown in FIG. 3, the nozzle plate 80 has the nozzle row 82 formed of the nozzles 81 arranged in the Y direction at a predetermined interval.

As shown in FIG. 4, the piezoelectric actuator 3 is disposed on the surface of the pressure chamber plate 10 which is opposite of the surface that is in contact with the first connection plate 20. The actuator 3 is formed by a stack of a plurality of piezoelectric sheets 4, each made of a ceramic material such as PZT. A common electrode 5 which is continuously formed so as to correspond to a plurality of pressure chambers 11 is disposed on the upper surface of the piezoelectric sheet 4 which is located at an odd-numbered position as counted from the lowermost piezoelectric sheet 4. A plurality of individual electrodes 6 which respectively correspond to a plurality of pressure chambers 11 are disposed on the upper surface of the piezoelectric sheet 4 which is located at an even-numbered position as counted from the lowermost piezoelectric sheet 4. The common electrode 5 and the individual electrodes 6 are connected to the control circuit substrate 100 via a relay wiring (not shown in the figure) which is disposed on an end face or a through hole of the piezoelectric sheets 4 (not shown in the figure) or the cable (such as a flexible substrate) 90 or the like.

When a voltage is selectively applied to the individual electrodes 6 of the actuator 3 by the control circuit substrate 100, a potential difference between the individual electrodes 6 and the common electrode 5 is generated. In response to the potential difference, an electric field acts on active areas on the piezoelectric sheets 4 between the individual electrodes 6 and the common electrode 5, which causes the piezoelectric sheets 4 to deform in the stacking direction. Ink is supplied from the exterior to the reservoir via an ink supply path which is not shown in the figure. After the ink is supplied to the reservoir, the ink is supplied to each of the pressure chambers 11 via the supply paths 32 (the first supply holes 32*a*, the connection flow paths 32*b*) and the second supply holes 22. As the piezoelectric sheets 4 deform, a pressure change is generated in the pressure chambers 11. In response to the pressure change, the ink in the pressure chambers 11 is ejected from the nozzles 81.

In such a configuration, at least the pressure chamber plate 10 corresponds to an example of a first member which has the pressure chambers. Further, the connection flow paths 32*b*, which form at least part of the flow path which extends between the reservoir and the pressure chambers 11, correspond to an example of a first flow path that is located upstream with respect to the pressure chambers 11 and controls the amount of a liquid which flows into the pressure chambers 11. In the second embodiment, the connection flow paths 32*b* are a portion having the smallest cross sectional area of the flow path between the reservoir and the pressure chambers 11. In the example shown in FIGS. 3 and 4, the cross sectional area of the connection flow paths 32*b* is the area of cross section in the direction perpendicular to the X direction. That is, the connection flow paths 32*b* increase a resistance to the ink flow, thereby adjusting the amount of ink which flows from the reservoir into the pressure chambers 11 to be constant, and the amount of ink which flows back from the pressure chambers 11 to the reservoir during deformation not to exceed a predetermined amount. The second connection plate 30 which includes the connection flow paths 32*b* corresponds to at least an example of a second member which is located between the pressure chamber plate 10 and the nozzle plate 80.

In the second embodiment, the pressure chamber plate 10 which corresponds to the first member is formed by calcining ceramics, and the second connection plate 30 which corresponds to the second member may be formed by processing a stainless steel or any other metal. Further, a ground wire 33 is connected to the second connection plate 30, and accordingly, the ink which passes through the connection flow paths 32 is grounded. Specifically, the connection flow paths 32*b* of the second connection plate 30 is formed as a long flow path in order to ensure the resistance to the ink flow. As a result, a large contact area with ink is provided. In the second embodiment, a contact area between the wall surface of the connection flow paths 32*b* and ink can be appropriately provided. Accordingly, ink is grounded via the second connection plate 30 and the ground wire 33 with certainty. The selection of the material for the first connection plate 20, the first reservoir plate 40, the second reservoir plate 50, the compliance plate 60, the nozzle plate 80 may be the same as that for the first connection plate 130, the reservoir plate 150, the compliance plate 160, the nozzle plate 170 of the first embodiment. The cover plate 70 may be also made of different materials such as metal, ceramics, resin, etc.

As seen from FIGS. 3 and 4, the connection flow paths 32*b* has the longitudinal axis which extends parallel to the plane of the nozzle plate 80. Providing the longitudinal axis of the connection flow paths 32*b* to be parallel to the plane of the nozzle plate 80 and other plates allows for an easy routing of the flow path between the reservoir and the pressure chambers 11 and increases a degree of freedom of design for positioning of the pressure chambers 11, the reservoir and the like.

Further, the reservoirs (42, 52, 152) in the liquid ejecting head 1 may be integrally formed of ceramics. That is, the reservoir plate 150 in the configuration shown in FIGS. 1 and 2 is made of ceramics, while the first and second reservoir plates 40, 50 in the configuration shown in FIGS. 3 and 4 are formed as a substantially single member made of ceramics. Such reservoir plates made of ceramics correspond to a third member. In this configuration, manufacturing can be simplified compared with the case where the reservoirs (42, 52, 152) are formed of a stack of a plurality of metal plates. This configuration is also advantageous for ensuring a sufficient volume of the reservoirs (42, 52, 152), since the depth of the reservoirs (42, 52, 152) in the Z direction can be easily achieved without stacking a plurality of metal plates.

Further, the liquid ejecting head 1 is mounted on an ink jet printer 200 and constitutes part of the ink jet recording head unit which is provided with ink supply paths that communicate with ink cartridges and the like. The ink jet printer 200 is an example of liquid ejecting apparatus.

Figure 5:
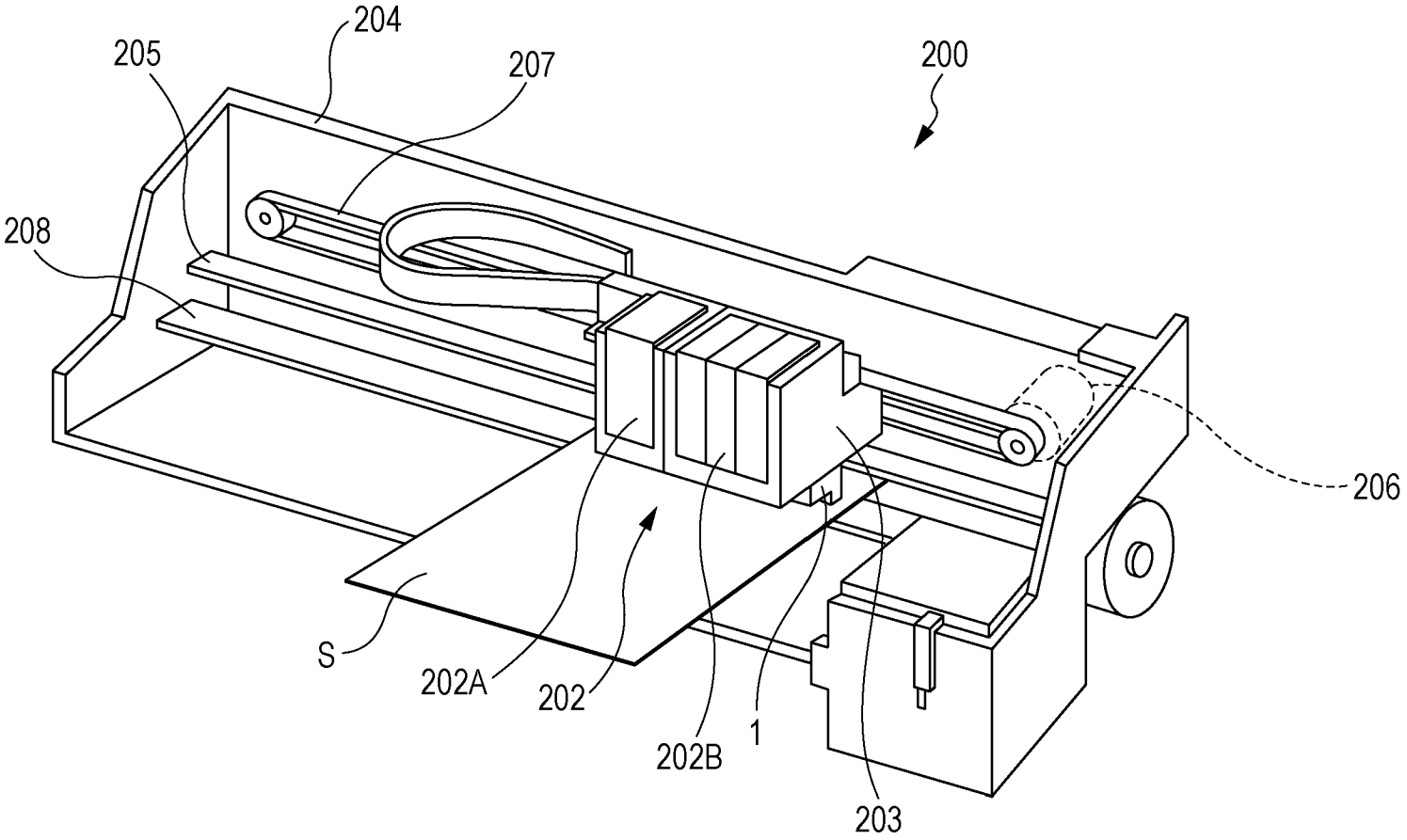
FIG. 5 is a schematic view of an example of an ink jet printer.

FIG. 5 is a schematic view of an example of the ink jet printer 200. The ink jet printer 200 includes an ink jet recording head unit (hereinafter, referred to as head unit 202) having a plurality of liquid ejecting heads 1, and ink cartridges 202A, 202B and the like are detachably attached on the head unit 202. A carriage 203 on which the head unit 202 is mounted is movable in the axis direction of a carriage shaft 205 which is mounted in an apparatus body 204. When a drive force from a drive motor 206 is transmitted to the carriage 203 via a plurality of gears, which are not shown in the figure, and a timing belt 207, the carriage 203 moves along the carriage shaft 205.

The apparatus body 204 also includes a platen 208 which extends along the carriage shaft 205 so that a printing media S which has been fed by rollers, which are not shown in the figure, and the like is transported on the platen 208. Then, ink is ejected from the nozzles 81, 171 of the liquid ejecting head 1 onto the transported printing media S to print an image on the printing medium S. The ink jet printer 200 is not limited to that having the head unit 202 which is movable in the above described manner, and may be a so-called line type printer which has a stationary liquid ejecting head 1 and performs printing by moving the print medium S.

The invention can be also applied to a liquid ejecting head and a liquid ejecting apparatus which eject a liquid other than ink. Examples of liquid ejecting head include, for example, color material ejecting heads used for manufacturing of the color filters for liquid crystal displays and the like, organic EL displays, electrode material ejecting heads used for forming electrode such as field emission displays (FED), and bioorganic ejecting heads used for manufacturing biochips and the like. The invention can be also applied to a liquid ejecting apparatus having the above liquid ejecting head.

The entire disclosure of Japanese Patent Application No. 2013-070583, filed Mar. 28, 2013 is incorporated by reference herein.

What is claimed is:

1. A liquid ejecting head which ejects a liquid from a nozzle of a nozzle plate by means of pressure change in a pressure chamber, comprising:

a first member made of ceramics and including the pressure chamber;

a second member located between the first member and the nozzle plate, the second member being made of a metal and including a first flow path at a position upstream to the pressure chamber so as to regulate an amount of liquid which flows into the pressure chamber, a third member made of ceramics, wherein the second member is between the first member and the third member; and a ground wire that grounds the second member, wherein the first flow path is at least part of a flow path which extends between a common liquid chamber from which the liquid is supplied to at least one pressure chamber and the pressure chamber, and wherein the second member includes the common liquid chamber.

2. The liquid ejecting head according to claim 1, wherein the first flow path is a portion having the smallest cross sectional area of the flow path which extends between the common liquid chamber and the pressure chamber.

3. A liquid ejecting head which ejects a liquid from a nozzle of a nozzle plate by means of pressure change in a pressure chamber, comprising:

a first member made of ceramics and including the pressure chamber;

a second member having a first flow path which is a portion having the smallest cross sectional area of the flow path which extends between a the common liquid chamber from which the liquid is supplied to at least one pressure chamber, a third member made of ceramics and including the common liquid chamber; and a ground wire that grounds the second member.

4. The liquid ejecting head according to claim 1, wherein the first flow path has a longitudinal axis which is parallel to a plane of the nozzle plate.

5. A liquid ejecting apparatus comprising the liquid ejecting head according to claim 1.

6. A liquid ejecting apparatus comprising the liquid ejecting head according to claim 2.

7. A liquid ejecting apparatus comprising the liquid ejecting head according to claim 3.

8. A liquid ejecting apparatus comprising the liquid ejecting head according to claim 4.

* * * * *